US012158317B2

(12) United States Patent
Cananzey

(10) Patent No.: US 12,158,317 B2
(45) Date of Patent: Dec. 3, 2024

(54) TRIGGER TRAVEL ADJUSTMENT ASSEMBLY

(71) Applicant: Gary Cananzey, Apollo Beach, FL (US)

(72) Inventor: Gary Cananzey, Apollo Beach, FL (US)

( * ) Notice: Subject to any disclaimer, the term of this patent is extended or adjusted under 35 U.S.C. 154(b) by 0 days.

(21) Appl. No.: 18/154,972

(22) Filed: Jan. 16, 2023

(65) Prior Publication Data

US 2023/0384050 A1 Nov. 30, 2023

Related U.S. Application Data

(60) Provisional application No. 63/330,549, filed on Apr. 13, 2022.

(51) Int. Cl.
*F41A 19/16* (2006.01)
*F41A 17/54* (2006.01)
*F41A 19/11* (2006.01)

(52) U.S. Cl.
CPC ..... *F41A 19/16* (2013.01); *F41A 17/54* (2013.01); *F41A 19/11* (2013.01)

(58) Field of Classification Search
CPC ..... F41A 19/11; F41A 19/16; F41A 17/54
See application file for complete search history.

(56) References Cited

U.S. PATENT DOCUMENTS 989,817 A * 4/1911 Siegel ..... F41A 17/46 42/70.06
1,249,576 A * 12/1917 Troncoso ..... F41A 17/46 42/70.06
2,813,362 A * 11/1957 Sunderland ..... F41A 19/16 42/69.02
2,881,547 A * 4/1959 Butler ..... F41A 3/18 42/16
3,188,764 A * 6/1965 Harding ..... F41A 19/10 42/69.01
3,206,884 A * 9/1965 Purvis ..... F41A 19/16 42/69.02
4,213,263 A * 7/1980 Brouthers ..... F41A 19/11 42/59
4,344,351 A * 8/1982 McQueen ..... F41A 19/33 89/129.02
4,819,358 A * 4/1989 Eder ..... F41A 19/16 42/59

(Continued)

FOREIGN PATENT DOCUMENTS

CH 516131 A * 11/1971
WO WO-02093100 A2 * 11/2002 ..... F41C 23/10
WO WO-2020112220 A1 * 6/2020

OTHER PUBLICATIONS

Machine Translation of Ziegenhahn. CH 516131 A. Nov. 1971. (Year: 1971).*

(Continued)

*Primary Examiner* — Gabriel J. Klein
(74) *Attorney, Agent, or Firm* — Brian J. Colandreo; Jeffrey T. Placker; Holland & Knight LLP

(57) ABSTRACT

A rearward-travel stop assembly for a firearm includes: a trigger guard portion; and an adjustable stop assembly coupled to the trigger guard portion and configured to limit rearward-travel of a trigger of the firearm by engaging a lower portion of the trigger.

22 Claims, 11 Drawing Sheets

(56) References Cited

U.S. PATENT DOCUMENTS

| | | | | | |
|---|---|---|---|---|---|
| 4,825,576 | A * | 5/1989 | Troncoso | F41A 17/54 | 42/70.07 |
| 5,857,280 | A * | 1/1999 | Jewell | F41A 19/45 | 42/70.05 |
| 6,032,396 | A * | 3/2000 | Shapiro | F41A 19/16 | 42/70.11 |
| 9,003,685 | B1 * | 4/2015 | Huang | F41A 19/11 | 42/70.07 |
| 9,541,342 | B1 * | 1/2017 | Blake | F41A 3/66 | |
| D934,374 | S * | 10/2021 | Rofkahr, Jr. | D22/108 | |
| 11,421,956 | B1 * | 8/2022 | Robinson | F41A 9/70 | |
| 2015/0308770 | A1 * | 10/2015 | Knapp | F41A 19/11 | 42/90 |
| 2023/0288161 | A1 * | 9/2023 | Fischietto | F41A 3/66 | |

OTHER PUBLICATIONS

Airsoft Trigger Guard with Hard Stop 3D print model. <https://www.cgtrader.com/3d-print-models/hobby-diy/mechanical-parts/airsoft-trigger-guard-with-hard-stop>. Ryan Triesel. Oct. 31, 2021. (Year: 2021).*

Airsoft Trigger Guard w/ Hard Stop. <https://cults3d.com/en/3d-model/various/airsoft-trigger-guard-w-hard-stop>. 3DAirdesign. Oct. 31, 2021. (Year: 2021).*

Triesel. Marked-up photos of previously cited Reference V. <https://www.cgtrader.com/3d-print-models/hobby-diy/mechanical-parts/airsoft-trigger-guard-with-hard-stop>. Oct. 31, 2021. (Year: 2021).*

Enhanced Trigger Guard. <https://www.youtube.com/watch?v=OjfhDyB65AE>. Jun. 12, 2011. (Year: 2011).*

* cited by examiner

TRIGGER TRAVEL ADJUSTMENT ASSEMBLY

RELATED CASE(S)

This application claims the benefit of U.S. Provisional Application No. 63/330,549 filed on 13 Apr. 2022, the contents of which are incorporated herein by reference.

TECHNICAL FIELD

This disclosure relates to travel adjustment assemblies in general and, more particularly, to trigger travel adjustment assemblies.

BACKGROUND

As is known in the art, firearms are available in various configurations such as semiautomatic fire, fully automatic fire, and burst fire. As their name implies, semiautomatic firearms may fire a single round each time the trigger is depressed. Fully automatic firearms may repeatedly fire rounds whenever the trigger is depressed and held in a depressed position. And burst fire firearms may fire a defined quantity of rounds (e.g., three rounds) each time the trigger is depressed.

Regardless of their configuration, firearms typically utilize some form of sear to accomplish the firing of the firearm. Specifically, the sear may be utilized to release the hammer so it may strike the firing pin and fire a round chambered within the firearm, wherein a trigger assembly may be utilized to release the sear and initiate the firing process. One popular type of weapon that utilizes such a sear to accomplish the firing of the firearm is the AR platform firearm (i.e., designed by Eugene Stoner and originally produced by ArmaLite).

SUMMARY OF DISCLOSURE

In one implementation, a rearward-travel stop assembly for a firearm includes: a trigger guard portion; and an adjustable stop assembly coupled to the trigger guard portion and configured to limit rearward-travel of a trigger of the firearm by engaging a lower portion of the trigger.

One or more of the following features may be included. The rearward-travel stop assembly may be a removable rearward-travel stop assembly. The rearward-travel stop assembly may be an integral rearward-travel stop assembly. The rearward-travel stop assembly may be configured to limit the rearward-travel of the trigger of the firearm to a point after the trigger breaks, thus limiting over-travel of the trigger after the sear releases. The rearward-travel stop assembly may be configured to limit the rearward-travel of the trigger of the firearm to a point before the trigger breaks, thus locking the trigger and rendering the gun inoperable. The adjustable stop assembly may include: a displaceable device configured to be longitudinally displaceable within the adjustable stop assembly to adjust the amount of rearward-travel of the trigger of the firearm. The adjustable stop assembly may further include: a locking device configured to releasably lock the displaceable device within the adjustable stop assembly. The rearward-travel stop assembly may further include: a finger rest device. The finger rest device may be configured to position a finger of a user of the fire arm. The rearward-travel stop assembly may further include: a finger positioning device. The finger positioning device may be configured to vertically position a finger of a user on the trigger of the fire arm.

In another implementation, a rearward-travel stop assembly for a firearm includes: a trigger guard portion; and an adjustable stop assembly coupled to the trigger guard portion and configured to limit rearward-travel of a trigger of the firearm by engaging a lower portion of the trigger, wherein the adjustable stop assembly includes: a displaceable device configured to be longitudinally displaceable within the adjustable stop assembly to adjust the amount of rearward-travel of the trigger of the firearm, and a locking device configured to releasably lock the displaceable device within the adjustable stop assembly; wherein the rearward-travel stop assembly Is a removable rearward-travel stop assembly.

One or more of the following features may be included. The rearward-travel stop assembly may be configured to limit the rearward-travel of the trigger of the firearm to a point after the trigger breaks, thus limiting over-travel of the trigger after the sear releases. The rearward-travel stop assembly may be configured to limit the rearward-travel of the trigger of the firearm to a point before the trigger breaks, thus locking the trigger and rendering the gun inoperable. The rearward-travel stop assembly may further include: a finger rest device. The finger rest device may be configured to position a finger of a user of the fire arm. The rearward-travel stop assembly may include: a finger positioning device. The finger positioning device may be configured to vertically position a finger of a user on the trigger of the fire arm.

In another implementation, a travel adjustment assembly kit for a firearm includes: a rearward-travel stop assembly including: a trigger guard portion; and an adjustable stop assembly coupled to the trigger guard portion and configured to limit rearward-travel of a trigger of the firearm by engaging a lower portion of the trigger; and a forward-travel adjuster assembly configured to limit forward-travel of the trigger of the firearm.

One or more of the following features may be included. The adjustable stop assembly may include: a displaceable device configured to be longitudinally displaceable within the adjustable stop assembly to adjust the amount of rearward-travel of the trigger of the firearm. The adjustable stop assembly may further include: a locking device configured to releasably lock the displaceable device within the adjustable stop assembly. The forward-travel adjuster assembly may include: a displaceable device configured to be longitudinally displaceable within a receiver of the firearm to adjust the amount of forward-travel of the trigger of the firearm. The forward-travel adjuster assembly may further include: a locking device configured to releasably lock the displaceable device within the receiver of the firearm. The rearward-travel stop assembly may be configured to limit the rearward-travel of the trigger of the firearm to a point after the trigger breaks, thus limiting over-travel of the trigger after the sear releases. The rearward-travel stop assembly may be configured to limit the rearward-travel of the trigger of the firearm to a point before the trigger breaks, thus locking the trigger and rendering the gun inoperable. The forward-travel adjuster assembly may be configured to limit the forward-travel of the trigger of the firearm to a point before the trigger breaks. The rearward-travel stop assembly may further include: a finger rest device. The finger rest device may be configured to position a finger of a user of the fire arm. The rearward-travel stop assembly may further include: a finger positioning device. The finger positioning device may be configured to vertically position a finger of a user on the trigger of the firearm.

The details of one or more implementations are set forth in the accompanying drawings and the description below. Other features and advantages will become apparent from the description, the drawings, and the claims.

BRIEF DESCRIPTION OF THE DRAWINGS

Like reference symbols in the various drawings indicate like elements.

DETAILED DESCRIPTION OF THE PREFERRED EMBODIMENTS

Figure 1:
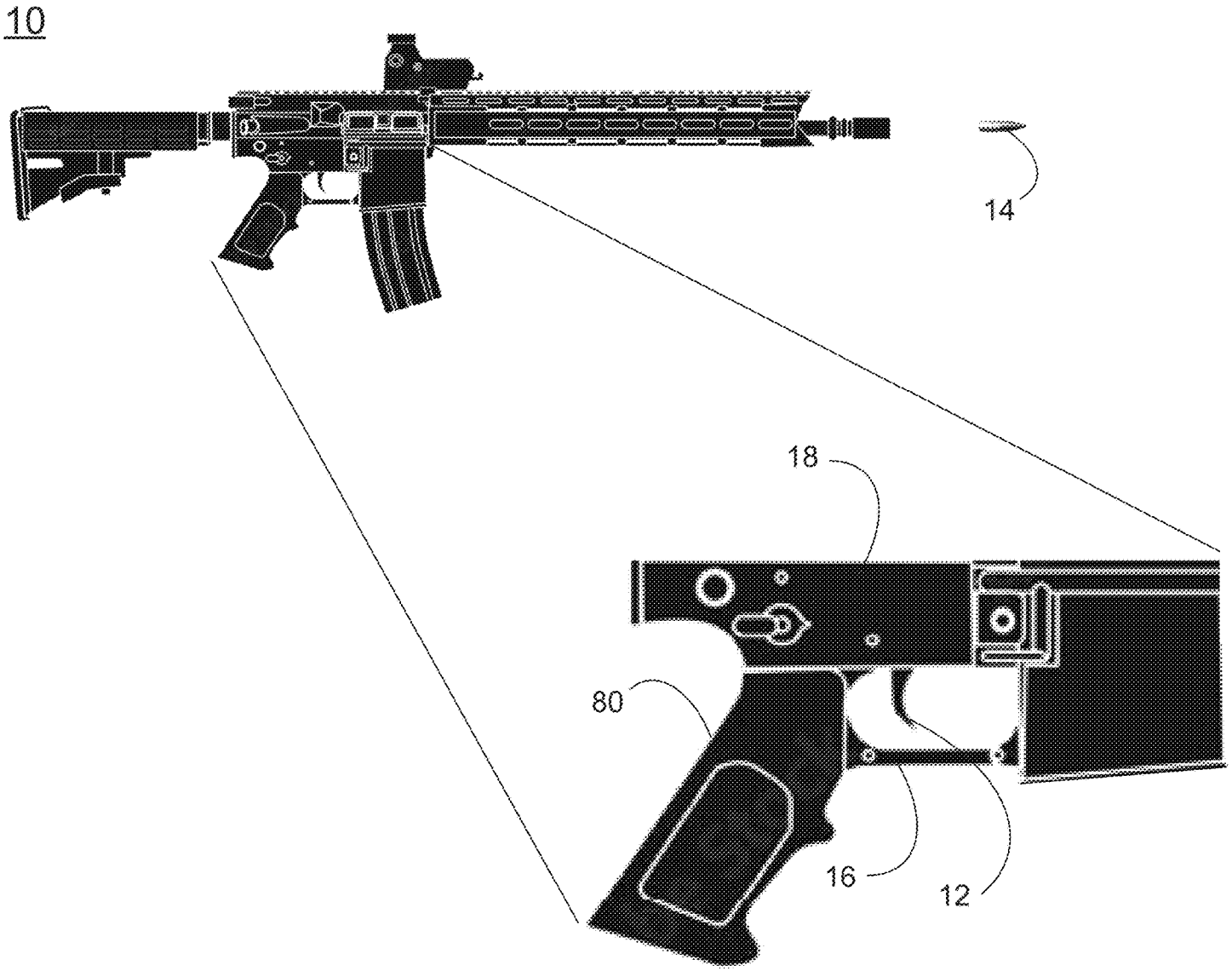
FIG. 1 is a diagrammatic view of a weapon platform.

System Overview:

Referring to FIG. 1, there is shown firearm 10. While in this particular example, firearm 10 is shown to be an AR platform firearm, this is for illustrative purposes only and is not intended to be a limitation of this disclosure, as other configurations are possible and are considered to be within the scope of this disclosure. Accordingly, other examples of firearm 10 may include but are not limited to other rifle platforms (e.g., the Remington 700 platform), handgun platforms (e.g., the 1911 platform), and various other weapon systems.

Figure 2A:
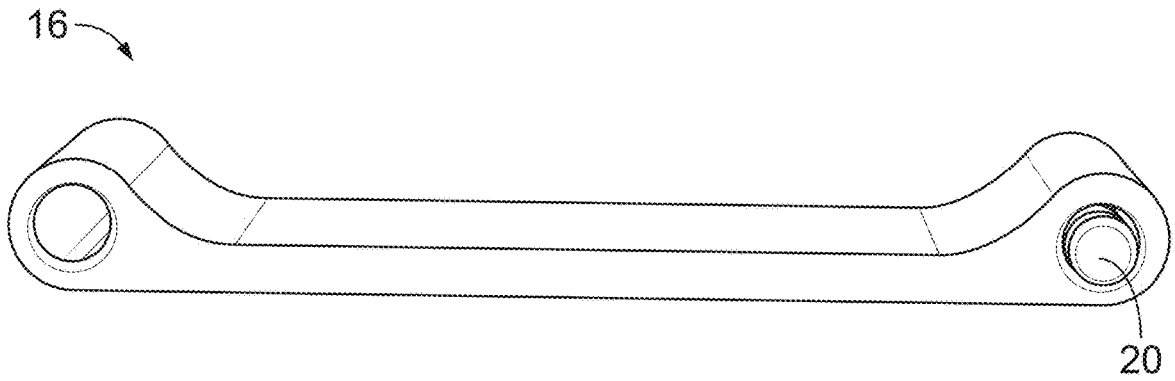
FIGS. 2A-2B are diagrammatic views of a traditional trigger guard.
Figure 2B:
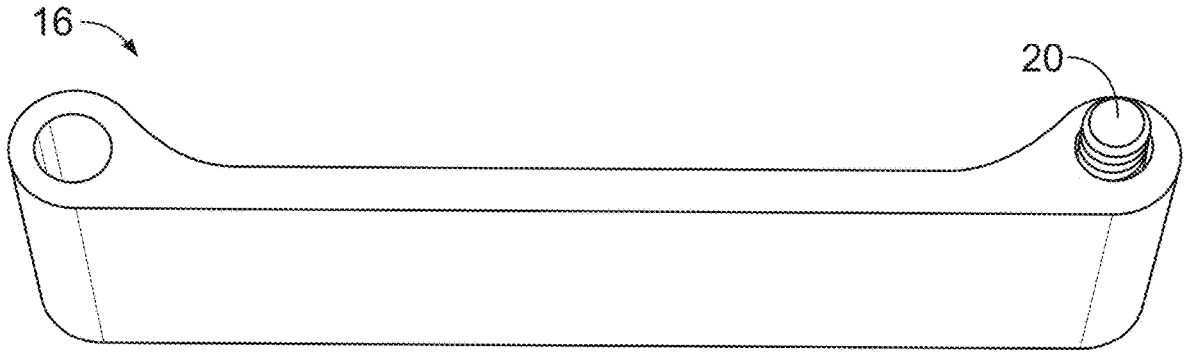

Firearm 10 may include trigger 12 configured to effectuate the firing of firearm 10 and the discharging of round 14. Firearm 10 may also include trigger guard 16 configured to shield trigger 12 to e.g., prevent the inadvertent discharging of firearm 10. Trigger guard 16 may be integral to receiver 18 of firearm 10. For example, receiver 18 of firearm 10 may be machined from e.g., an aluminum billet and, therefore, trigger guard 16 may be machined from that same aluminum billet and not removeable from receiver 18 of firearm 10. Alternatively, trigger guard 16 may be a separate item and removeable from receiver 18 of firearm 10, as is standard on milspec (i.e., military specification) AR15s. Referring to FIGS. 2A-2B, there is shown such an example of a "removable" trigger guard (e.g., trigger guard 16), wherein this "removable" trigger guard (e.g., trigger guard 16) may include one or more pins (e.g., pin 20) to allow for the removal of the "removable" trigger guard (e.g., trigger guard 16) from receiver 18 of firearm 10.

Figure 3:
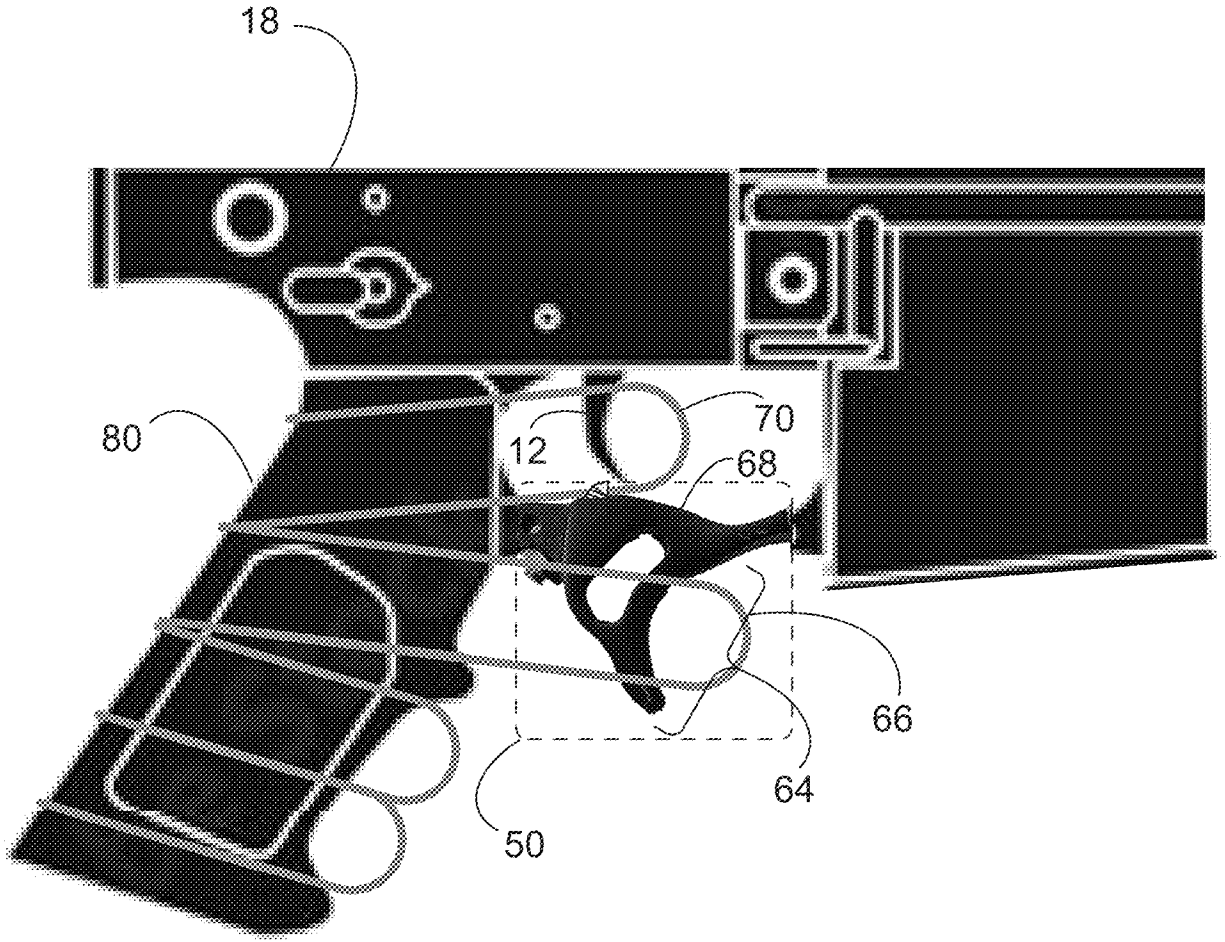
FIGS. 3-6 are diagrammatic views of one implementation of a rearward-travel stop assembly in accordance with various embodiments of the present disclosure.

Referring also to FIG. 3 and regardless of whether trigger guard 16 is removeable from (or integral to) receiver 18 of firearm 10, firearm 10 may include a rearward-travel stop assembly (e.g., rearward-travel stop assembly 50) configured to control the rearward-travel of trigger 12.

For example, rearward-travel stop assembly 50 may be configured to limit the rearward-travel of the trigger (e.g., trigger 12) of firearm 10 to a point after the trigger (e.g., trigger 12) breaks, thus limiting over-travel of the trigger (e.g., trigger 12) after the sear releases. As is known in the art, the point at which the trigger "breaks" is the point in the trigger travel at which the firearm discharges by e.g., releasing the hammer. Accordingly and in such a configuration, once the trigger (e.g., trigger 12) breaks and firearm 10 discharges round 14, rearward-travel stop assembly 50 may prevent the trigger (e.g., trigger 12) from travelling any further in a rearward direction; thus enhancing the feel of trigger 12 and the overall enjoyment of firearm 10.

Additionally/alternatively, rearward-travel stop assembly 50 may be configured to limit the rearward-travel of the trigger (e.g., trigger 12) of firearm 10 to a point before the trigger (e.g., trigger 12) breaks, thus locking the trigger (e.g., trigger 12) forward of the breaking point and rendering the gun inoperable. Accordingly and in such a configuration, rearward-travel stop assembly 50 may position (i.e., lock) the trigger (e.g., trigger 12) forward of the breaking point of the trigger (e.g., trigger 12), thus preventing firearm 10 from discharging round 14.

Figure 4:
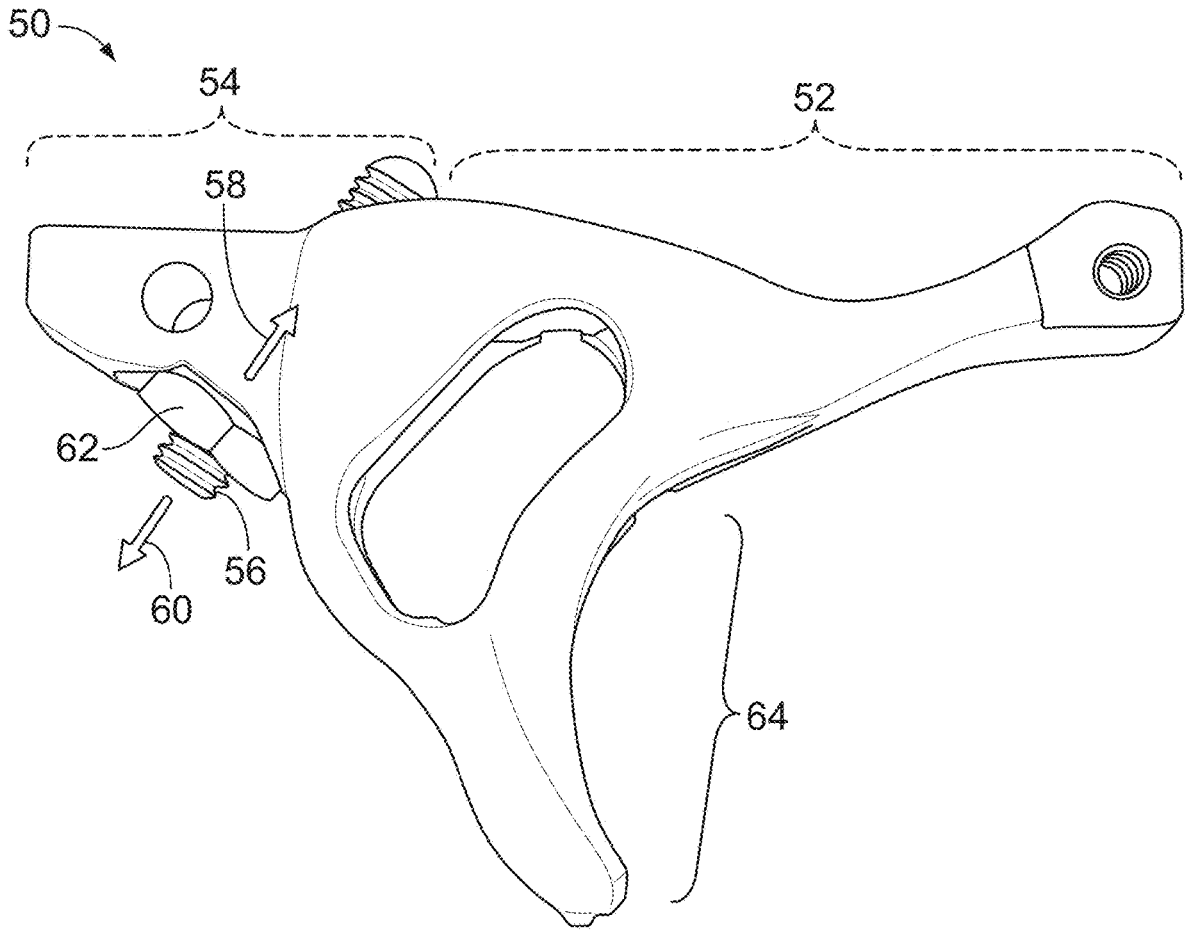
Figure 5:
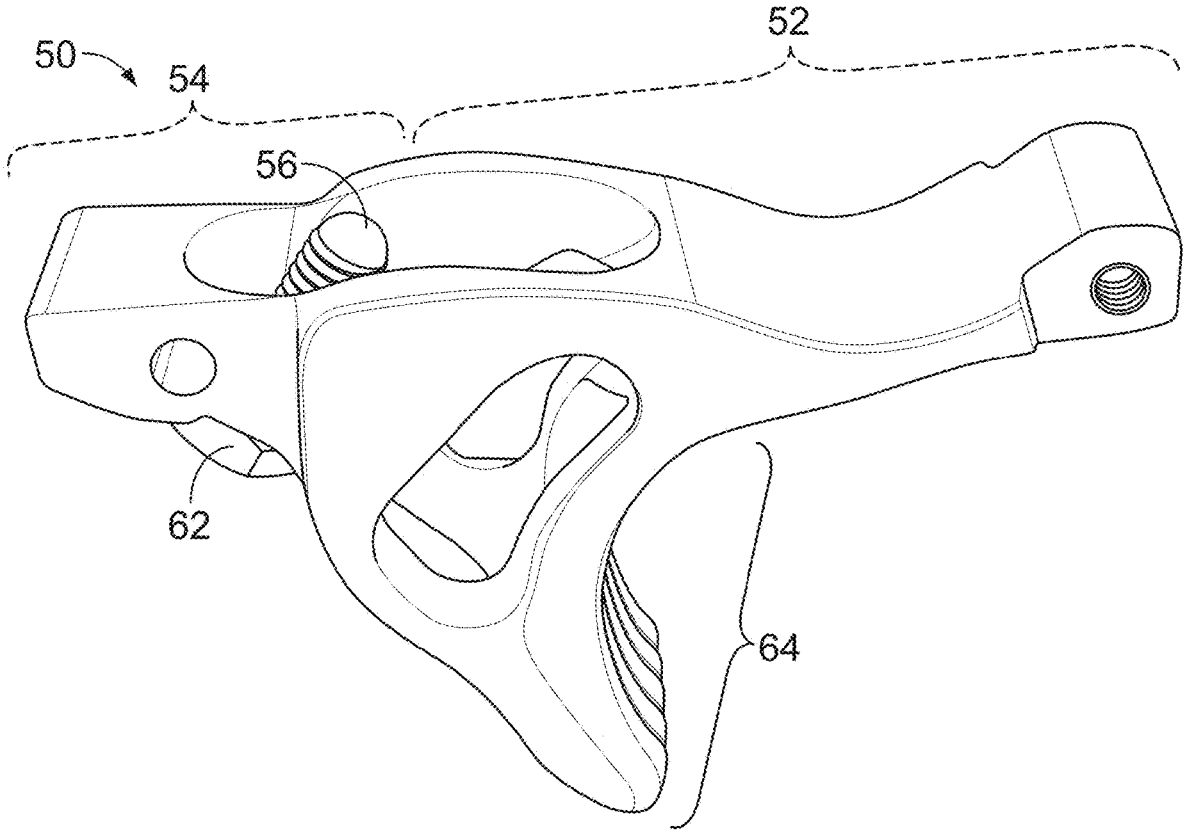
Figure 6:
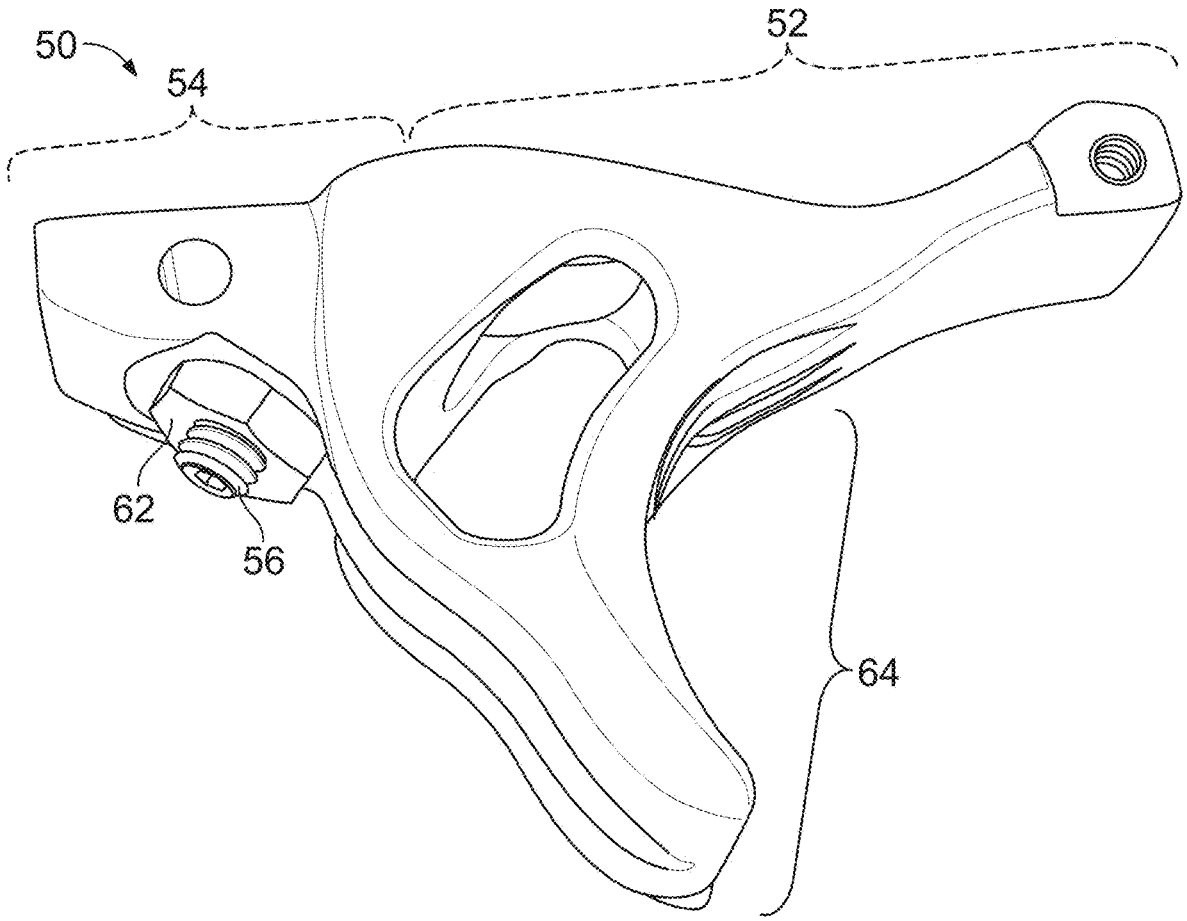

Referring also to FIGS. 4-6, rearward-travel stop assembly 50 may include: a trigger guard portion (e.g., trigger guard portion 52) and an adjustable stop assembly (e.g., adjustable stop assembly 54) coupled to the trigger guard portion (e.g., trigger guard portion 52). Adjustable stop assembly 54 may be configured to limit rearward-travel of trigger 12 of firearm 10 by engaging a lower portion of the trigger (e.g., trigger 12). Specifically, by limiting rearward-travel of trigger 12 of firearm 10 by engaging a lower portion of the trigger (e.g., trigger 12), the point of contact between the lower portion of trigger 12 and adjustable stop assembly 54 is in line with the hand of the user and the grip of firearm 10. This configuration is considerably different than a system that limits rearward-travel of trigger 12 and is located within receiver 18 of firearm 10. Such a receiver-based system may limit rearward-travel of trigger 12 at the point of rotation of trigger 12 (either by a mechanical stop assembly or exceeding the maximum swing of the trigger about its pivot point). Either way, such a system may cause a torquing/twisting about the pivot point of trigger 12, which may compromise the accuracy (and/or frustrate the use of firearm 10).

As discussed above, rearward-travel stop assembly 50 may be an integral rearward-travel stop assembly, wherein rearward-travel stop assembly 50 is physically a portion of receiver 18 and, therefore, is not removable from receiver 18. Accordingly and in such a configuration, rearward-travel stop assembly 50 may be a portion of firearm 10 as it was produced by its manufacturer. Further and as discussed above, rearward-travel stop assembly 50 may be a removable rearward-travel stop assembly, wherein rearward-travel stop assembly 50 is detachable from receiver 18 and, therefore, removable.

Accordingly and in such a configuration, rearward-travel stop assembly 50 may be an aftermarket item that is user-installable onto an existing firearm (e.g., firearm 10).

The adjustable stop assembly (e.g., adjustable stop assembly 54) may include: a displaceable device (e.g., displaceable device 56) configured to be longitudinally displaceable within the adjustable stop assembly (e.g., adjustable stop assembly 54) to adjust the amount of rearward-travel of the trigger (e.g., trigger 12) of firearm 10. Specifically, displaceable device 56 may be moved toward trigger 12 (in the direction of 58) to allow for less rearward travel of trigger 12 (before contacting displaceable device 56) and/or moved away from trigger 12 (in the direction of 60) to allow for more rearward travel of trigger 12 (before contacting displaceable device 56).

The adjustable stop assembly (e.g., adjustable stop assembly 54) may further include: a locking device (e.g., locking device 62) configured to releasably lock the displaceable device (e.g., displaceable device 56) within the adjustable stop assembly (e.g., adjustable stop assembly 54). As shown in the figures of this disclosure, one implementation of displaceable device 56 may be a portion of a threaded rod that is threaded into adjustable stop assembly 54. And in such a configuration, locking device 62 may be a nut that is threaded around displaceable device 56 and is tightened down onto adjustable stop assembly 54, thus effectively locking displaceable device 56 with respect to adjustable stop assembly 54.

In some implementations of rearward-travel stop assembly 50, rearward-travel stop assembly 50 may include a finger rest device (e.g., finger rest device 64), wherein this finger rest device (e.g., finger rest device 64) may be configured to position a finger (e.g., middle finger 66) of a user of fire arm 10. In such a configuration, the positioning of the finger (e.g., middle finger 66) of the user on fire arm 10 further forward with respect to trigger 12 may provide a more stable grip of firearm 10.

In some implementations of rearward-travel stop assembly 50, rearward-travel stop assembly 50 may include a finger positioning device (e.g., finger positioning device 68), wherein the finger positioning device (e.g., finger positioning device 68) may be configured to vertically position a finger (e.g., index finger 70) of the user on the trigger (e.g., trigger 12) of fire arm 10.

Figure 7:
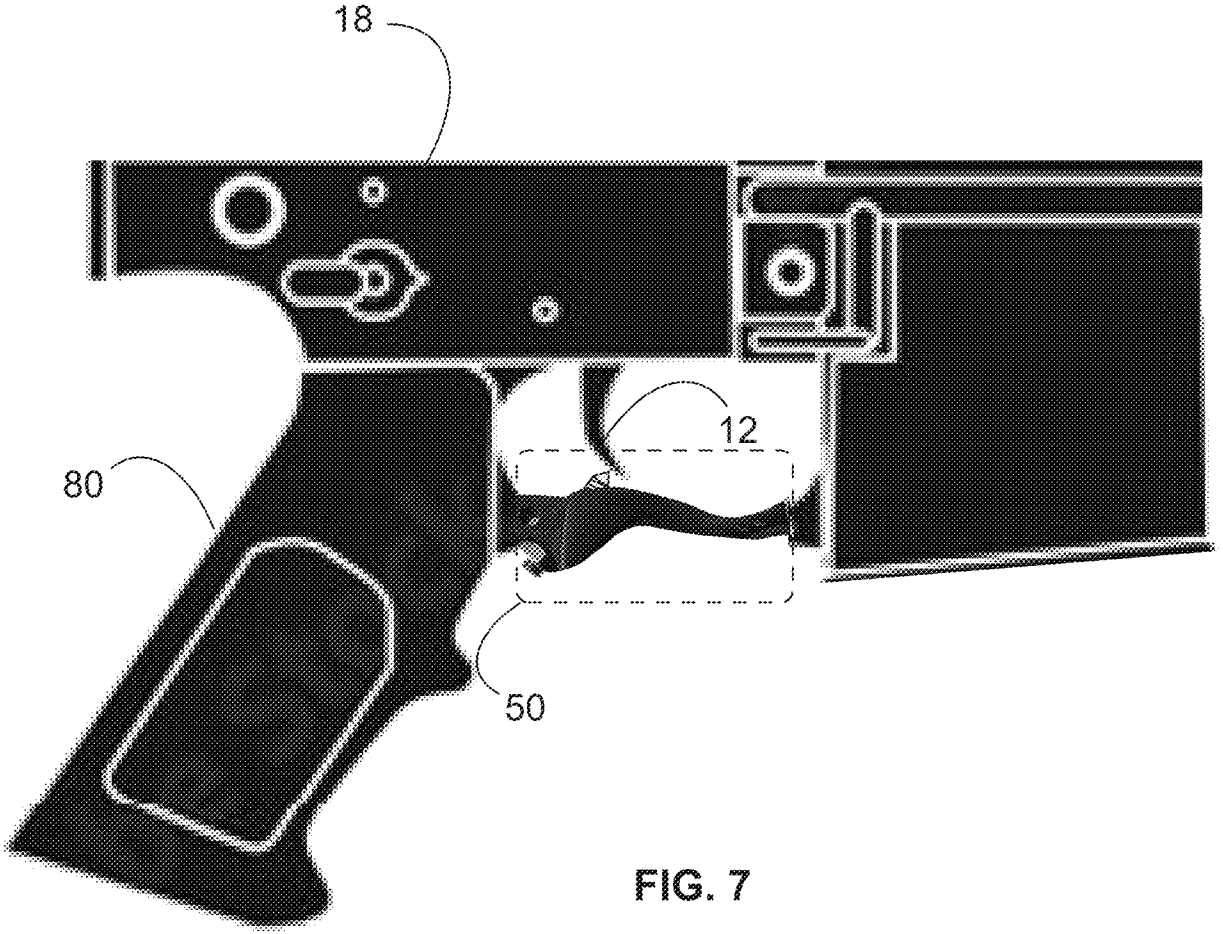
FIG. 7 is a diagrammatic view of another implementation of a rearward-travel stop assembly in accordance with various embodiments of the present disclosure.

While the above-described implementations of rearward-travel stop assembly 50 is described as possibly including the finger rest device (e.g., finger rest device 64) and/or the finger positioning device (e.g., finger positioning device 68), this is for illustrative purposes only and are not required for implementation of this disclosure. For example, rearward-travel stop assembly 50 may include only one (or neither) of finger rest device 64 and/or finger positioning device 68 (as shown in FIG. 7).

Figure 8:
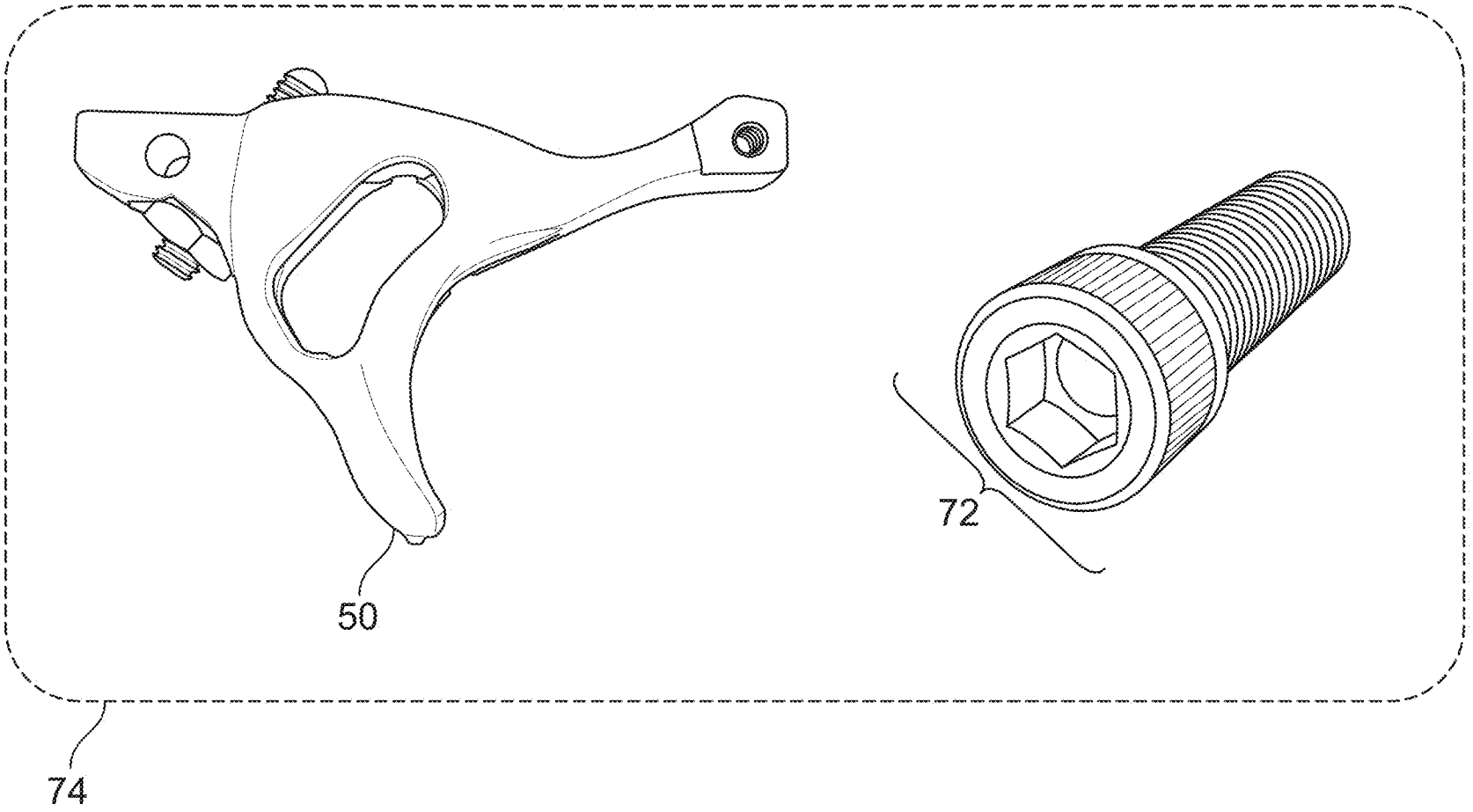
FIG. 8 is a diagrammatic view of a travel adjustment assembly kit in accordance with various embodiments of the present disclosure.
Figure 9:
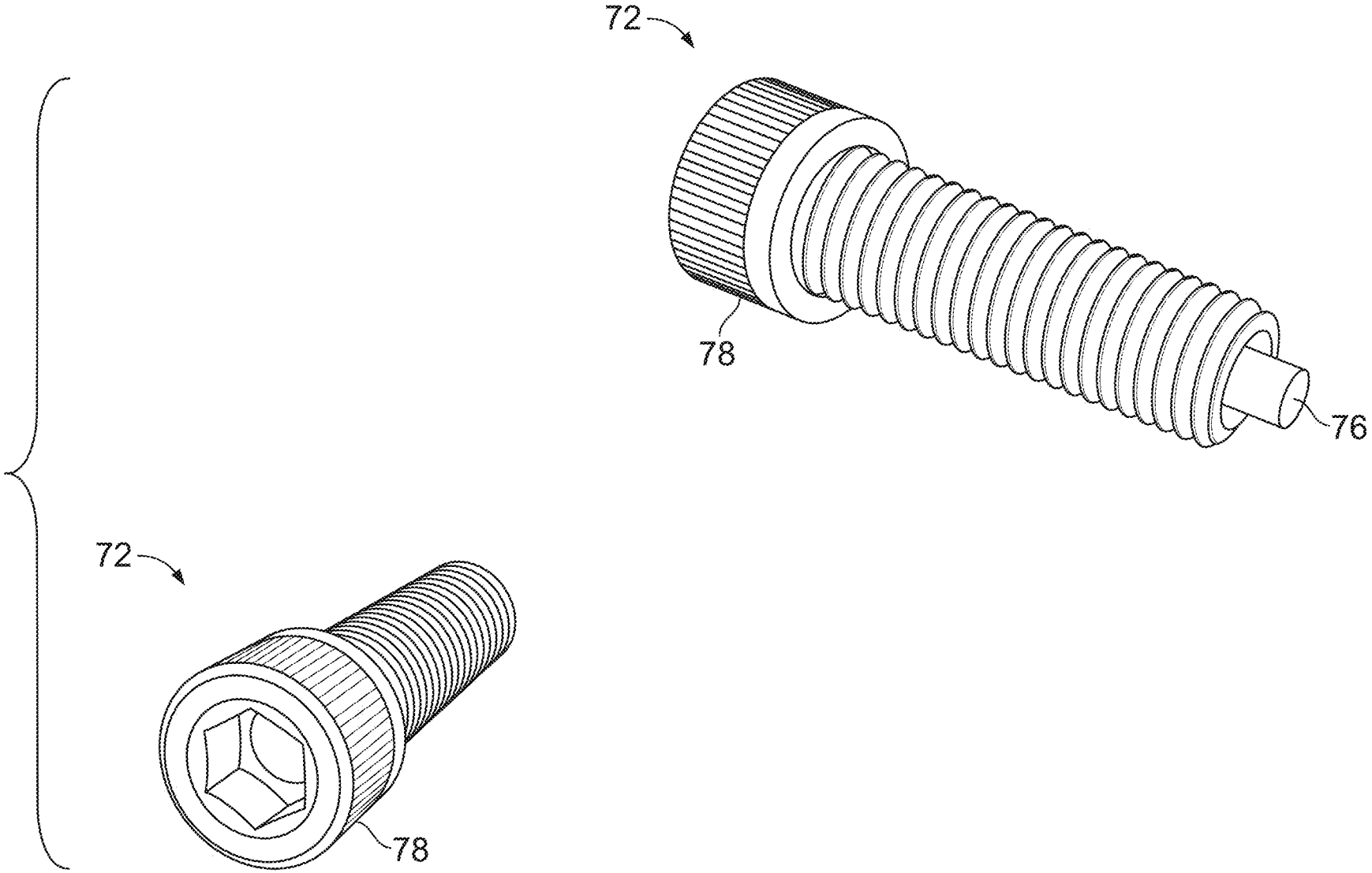
FIG. 9 is a diagrammatic view of a forward-travel adjuster assembly in accordance with various embodiments of the present disclosure.

Referring also to FIGS. 8-9, rearward-travel stop assembly 50 may be combined with a forward-travel adjuster assembly (e.g., forward-travel adjuster assembly 72) to form a travel adjustment assembly kit (e.g., travel adjustment assembly kit 74) for firearm 10, wherein the forward-travel adjuster assembly (e.g., forward-travel adjuster assembly 72) may be configured to limit forward-travel of the trigger (e.g., trigger 12) of firearm 10. Specifically, the forward-travel adjuster assembly (e.g., forward-travel adjuster assembly 72) may be configured to limit the forward-travel of the trigger (e.g., trigger 12) of firearm 10 to a point just before trigger 12 breaks, thus limiting pre-travel of trigger 12. As discussed above, rearward-travel stop assembly 50 may be configured to limit the rearward-travel of trigger 12 of firearm 10 to a point just after trigger 12 breaks, thus limiting over-travel of trigger 12.

Accordingly and through the use of travel adjustment assembly kit 74 (i.e., the combination of rearward-travel stop assembly 50 and forward-travel adjuster assembly 72), the forward-travel of trigger 12 may be limited so that the rest position of trigger 12 is just prior to the breaking point of trigger 12 and the rearward-travel of trigger 12 may be limited so that the actuated position of trigger 12 is just after the breaking point of trigger 12.

The forward-travel adjuster assembly (e.g., forward-travel adjuster assembly 72) may include a displaceable device (e.g., displaceable device 76) configured to be longitudinally displaceable within a receiver (e.g., receiver 18) of firearm 10 to adjust the amount of forward-travel of trigger 12 of firearm 10. The forward-travel adjuster assembly (e.g., forward-travel adjuster assembly 72) may further include a locking device (e.g., locking device 78) configured to releasably lock the displaceable device (e.g., displaceable device 76) within receiver 18 of firearm 10. Specifically and in one implementation, forward-travel adjuster assembly 72 may be configured to replace the grip bolt of an AR platform firearm, wherein locking device 78 of forward-travel adjuster assembly 72 may be configured to affix grip 80 to receiver 18 of firearm 10, wherein displaceable device 76 (which may have an interference fit with respect to locking device 78) may be configured to interact with trigger 12 (and/or a portion of a trigger assembly associated with trigger 12) to e.g., bias trigger 12 rearward toward the breaking point of trigger 12 (thus limiting forward travel of trigger 12).

Figure 10:
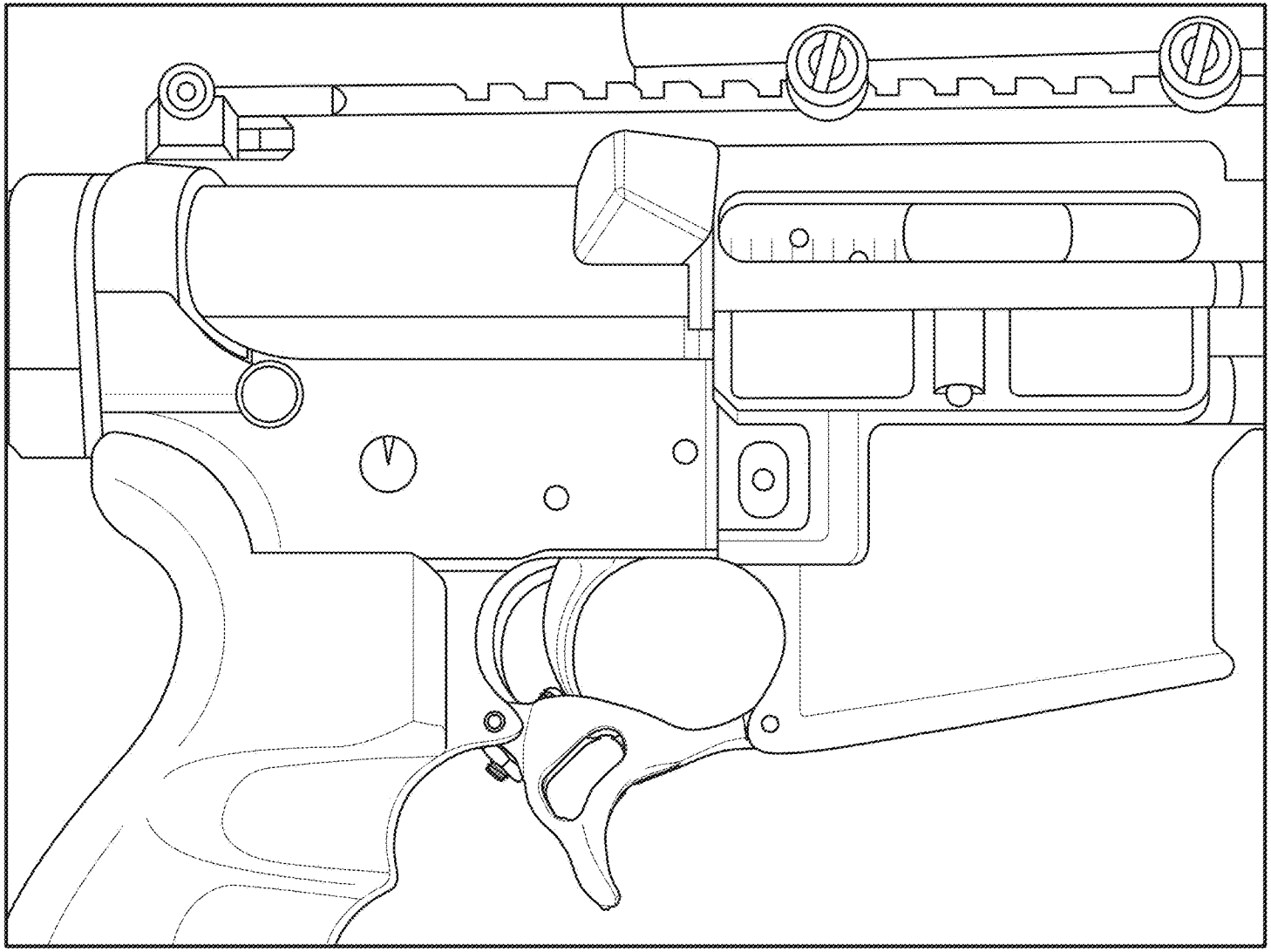
FIGS. 10-11 are diagrammatic views of a finger positioning device in accordance with various embodiments of the present disclosure.
Figure 11:
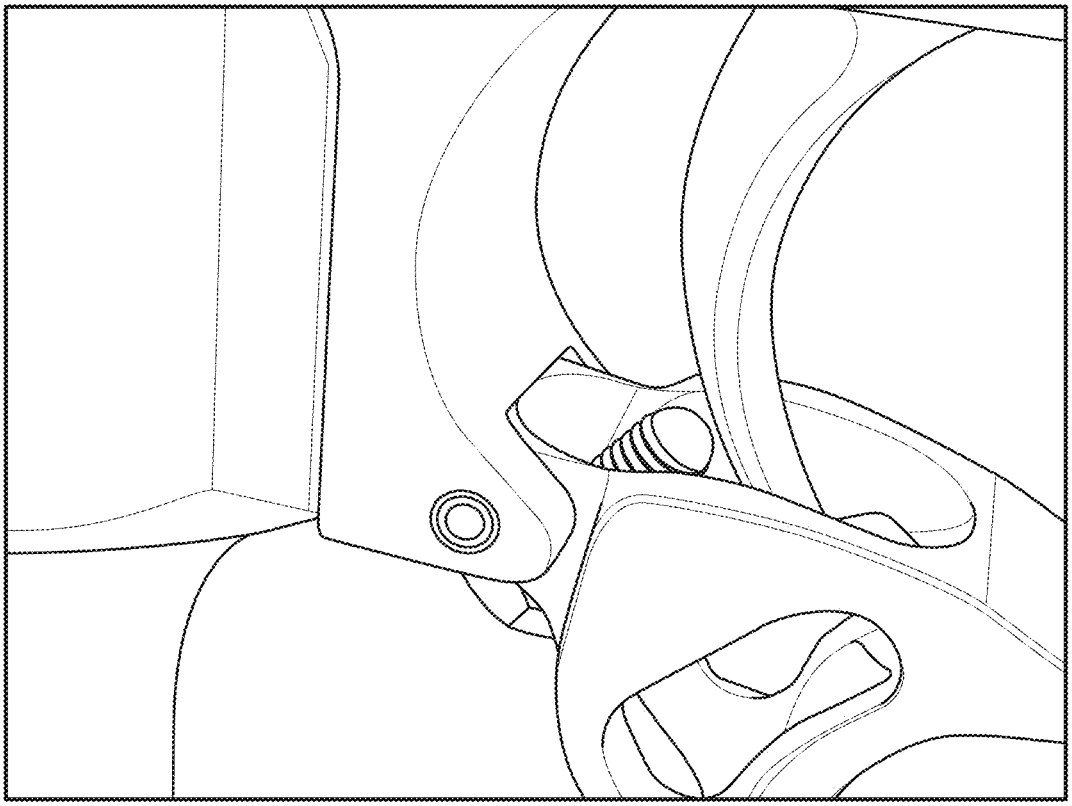

As discussed previously, in some implementations rearward-travel stop assembly may include a finger positioning device that may be configured to vertically position a finger of the user on the trigger of firearm. Referring also to FIGS. 10 and 11, in a particular implementation, the finger positioning device may include an upwardly convex shape configured to rise to the bottom of the trigger. As shown in the illustrated example embodiment, the upwardly convex shape of the finger positioning device may be configured to vertically position a finger of a user on the trigger of the firearm. Additionally, as shown in the illustrated example embodiment, the finger positioning device may include a groove in the upwardly convex shape permitting travel of the trigger therethrough during actuation of the trigger.

General:

In general, the various operations of method described herein may be accomplished using or may pertain to components or features of the various systems and/or apparatus with their respective components and subcomponents, described herein.

The presence of broadening words and phrases such as "one or more," "at least," "but not limited to" or other like phrases in some instances shall not be read to mean that the narrower case is intended or required in instances where such broadening phrases may be absent.

Additionally, the various embodiments set forth herein are described in terms of example block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

While various embodiments of the present disclosure have been described above, it should be understood that they have been presented by way of example only, and not of limitation. Likewise, the various diagrams may depict an example architectural or other configuration for the disclosure, which is done to aid in understanding the features and functionality that can be included in the disclosure. The disclosure is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the present disclosure. Additionally, with regard to flow diagrams, operational descriptions and method claims, the order in which the steps are presented herein shall not mandate that various embodiments be implemented to perform the recited functionality in the same order unless the context dictates otherwise.

Although the disclosure is described above in terms of various example embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the disclosure, whether or not such embodiments are described and whether or not such features are presented as being a part of a described embodiment. Thus, the breadth and scope of the present disclosure should not be limited by any of the above-described example embodiments, and it will be understood by those skilled in the art that various changes and modifications to the previous descriptions may be made within the scope of the claims.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated.

A number of implementations have been described. Having thus described the disclosure of the present application in detail and by reference to embodiments thereof, it will be apparent that modifications and variations are possible without departing from the scope of the disclosure defined in the appended claims.

What is claimed is:

1. A rearward-travel stop assembly for a firearm comprising:

a trigger guard portion;

an adjustable stop assembly coupled to the trigger guard portion and configured to limit rearward-travel of a trigger of the firearm by engaging a lower portion of the trigger;

wherein the rearward-travel stop assembly is a removable rearward-travel stop assembly integrated with the trigger guard portion, and wherein the trigger guard portion is configured to be removably affixed to the firearm adjacent both a forward portion of the trigger guard portion and a rearward portion of the trigger guard portion; and a finger positioning device including an upwardly convex shape configured to rise to the bottom of the trigger, and configured to vertically position a finger of a user on the trigger of the firearm;

wherein the finger positioning device includes a groove in the upwardly convex shape permitting travel of the trigger therethrough during actuation of the trigger.

2. The rearward-travel stop assembly of claim 1 wherein the rearward-travel stop assembly is configured to limit the rearward-travel of the trigger of the firearm to a point after the trigger breaks, thus limiting over-travel of the trigger after a sear releases.

3. The rearward-travel stop assembly of claim 1 wherein the rearward-travel stop assembly is configured to limit the rearward-travel of the trigger of the firearm to a point before the trigger breaks, thus locking the trigger and rendering the firearm inoperable.

4. The rearward-travel stop assembly of claim 1 wherein the adjustable stop assembly includes:

a displaceable device configured to be longitudinally displaceable within the adjustable stop assembly to adjust the amount of rearward-travel of the trigger of the firearm.

5. The rearward-travel stop assembly of claim 4 wherein the adjustable stop assembly further includes:

a locking device configured to releasably lock the displaceable device within the adjustable stop assembly.

6. The rearward-travel stop assembly of claim 1 further comprising:

a finger rest device.

7. The rearward-travel stop assembly of claim 6 wherein the finger rest device is configured to position a finger of a user of the firearm.

8. A rearward-travel stop assembly for a firearm comprising:

a trigger guard portion; and an adjustable stop assembly coupled to the trigger guard portion and configured to limit rearward-travel of a trigger of the firearm by engaging a lower portion of the trigger, wherein the adjustable stop assembly includes:

a displaceable device configured to be longitudinally displaceable within the adjustable stop assembly to adjust the amount of rearward-travel of the trigger of the firearm, a locking device configured to releasably lock the displaceable device within the adjustable stop assembly; and a finger positioning device including an upwardly convex shape configured to rise to the bottom of the trigger, and configured to vertically position a finger of a user on the trigger of the firearm;

wherein the finger positioning device includes a grove in the upwardly convex shape permitting travel of the trigger therethrough during actuation of the trigger wherein the rearward-travel stop assembly is a removable rearward-travel stop assembly, and wherein the trigger guard portion is configured to be removably affixed to the firearm adjacent both a forward portion of the trigger guard portion and a rearward portion of the trigger guard portion.

9. The rearward-travel stop assembly of claim 8 wherein the rearward-travel stop assembly is configured to limit the rearward-travel of the trigger of the firearm to a point after the trigger breaks, thus limiting over-travel of the trigger after a sear releases.

10. The rearward-travel stop assembly of claim 8 wherein the rearward-travel stop assembly is configured to limit the rearward-travel of the trigger of the firearm to a point before the trigger breaks, thus locking the trigger and rendering the firearm inoperable.

11. The rearward-travel stop assembly of claim 8 further comprising:

a finger rest device.

12. The rearward-travel stop assembly of claim 11 wherein the finger rest device is configured to position a finger of a user of the firearm.

13. A travel adjustment assembly kit for a firearm comprising:

a rearward-travel stop assembly including:

a trigger guard portion; and an adjustable stop assembly coupled to the trigger guard portion and configured to limit rearward-travel of a trigger of the firearm by engaging a lower portion of the trigger;

a forward-travel adjuster assembly configured to limit forward-travel of the trigger of the firearm; and a finger positioning device including an upwardly convex shape configured to rise to the bottom of the trigger, and configured to vertically position a finger of a user on the trigger of the firearm;

wherein the finger positioning device includes a groove in the upwardly convex shape permitting travel of the trigger therethrough during actuation of the trigger;

wherein the adjustable stop assembly is a removable adjustable stop assembly integrated with the trigger guard portion, and wherein the trigger guard portion is configured to be removably affixed to the firearm adjacent both a forward portion of the trigger guard portion and a rearward portion of the trigger guard portion.

14. The travel adjustment assembly kit of claim 13 wherein the adjustable stop assembly includes:

a displaceable device configured to be longitudinally displaceable within the adjustable stop assembly to adjust the amount of rearward-travel of the trigger of the firearm.

15. The travel adjustment assembly kit of claim 14 wherein the adjustable stop assembly further includes:

a locking device configured to releasably lock the displaceable device within the adjustable stop assembly.

16. The travel adjustment assembly kit of claim 13 wherein the forward-travel adjuster assembly includes:

a displaceable device configured to be longitudinally displaceable within a receiver of the firearm to adjust the amount of forward-travel of the trigger of the firearm.

17. The travel adjustment assembly kit of claim 16 wherein the forward-travel adjuster assembly further includes:

a locking device configured to releasably lock the assembly displaceable device within the receiver of the firearm.

18. The travel adjustment assembly kit of claim 13 wherein the rearward-travel stop assembly is configured to limit the rearward-travel of the trigger of the firearm to a point after the trigger breaks, thus limiting over-travel of the trigger after a sear releases.

19. The travel adjustment assembly kit of claim 13 wherein the rearward-travel stop assembly is configured to limit the rearward-travel of the trigger of the firearm to a point before the trigger breaks, thus locking the trigger and rendering the firearm inoperable.

20. The travel adjustment assembly kit of claim 13 wherein the forward-travel adjuster assembly is configured to limit the forward-travel of the trigger of the firearm to a point before the trigger breaks.

21. The travel adjustment assembly kit of claim 13 wherein the rearward-travel stop assembly further includes:

a finger rest device.

22. The travel adjustment assembly kit of claim 21 wherein the finger rest device is configured to position a finger of a user of the firearm.

* * * * *